United States Patent [19]

Garvin

[11] 4,403,564

[45] Sep. 13, 1983

[54] ANCHOR

[76] Inventor: Robert E. Garvin, 316 Millar Ave., El Cajon, Calif. 92020

[21] Appl. No.: 239,382

[22] Filed: Mar. 2, 1981

[51] Int. Cl.[3] ..... B63B 21/46

[52] U.S. Cl. ..... 114/299; 114/303

[58] Field of Search ..... 114/297-301, 114/304, 307, 303, 302

[56] References Cited

U.S. PATENT DOCUMENTS

| | | | |
|---|---|---|---|
| 721,663 | 3/1903 | Brooke | 114/304 |
| 1,583,795 | 5/1926 | Pasturzak | 114/303 |
| 2,424,040 | 7/1947 | Long | 114/299 |
| 2,490,583 | 12/1949 | Dunkelberger | 114/303 |
| 2,643,630 | 6/1953 | Buck | 114/303 |
| 2,863,415 | 12/1958 | Schofield | 114/303 |

FOREIGN PATENT DOCUMENTS

| | | | |
|---|---|---|---|
| 485605 | 10/1953 | Italy | 114/299 |

*Primary Examiner*—Trygve M. Blix
*Assistant Examiner*—Stephen P. Avila

[57] ABSTRACT

A boat anchor having elongated flat flukes clustered on the shank in variable arrangements and a bail secured at each end of the shank for attaching the line to the boat.

1 Claim, 5 Drawing Figures

ANCHOR

BACKGROUND OF THE INVENTION

The pleasure of boating is commonly marred by problems with anchoring. Much of the difficulty is because of the conditions at the place of anchoring. Conditions vary from soft mud to hard rock. Objects sometimes prevent easy retrieval. Before my invention, there was no way to change an anchor's characteristics to accommodate particular conditions. Adjustments could not be made. Prior patents, such as U.S. Pat. No. 4,080,923, do disclose variations of the well known Danforth anchor. None have resorted to anything other than a single fixed arrangement of parts, i.e. mode, to cope with the great variety of circumstances under which an anchor must function.

My improved anchor features a fluke assembly which can serve in various modes. First, it can be made to pierce a lake or river bottom with the weight of the anchor concentrated at a single point. Or, on the other hand, the assembly can be so arranged that the flukes serve much like the spokes of a wheel for rotation out of danger of being fouled on treacherous ground. Also, the assembly may be set for any adjustment between the two described extremes. An important feature of my invention is that the particular arrangement may be established "on the spot" so the operator can use the arrangement which will best serve his needs at the particular location.

As another novel feature I have provided appropriate linkage between the anchor and line to boat to maximize both the holding power and the retrievability of my anchor.

SUMMARY

To accomplish the described purposes I have provided flat elongated flukes with orifice transversally through their midsections. Each has end portions bent at an angle in respect to planar control sections. All ends are pointed. The flukes are rotably mounted on a shaft, in tandem, as the crown of the anchor. They are clamped between a shoulder on the shaft and a threaded fastener at the end of the shaft. Each end of the shaft is connected by a bail that extends over the flukes. The bail is a slender bar having an obtuse angle proximate to the tips of the flukes and a right angle proximate to their midsections whereby linkage from the boat line, slidably mounted on the bail, will cause the fluke to imbed for holding and later dislodge for moving to a different location.

DESCRIPTION OF PREFERRED EMBODIMENT

Figures 1, 2, 3, 4, 5:
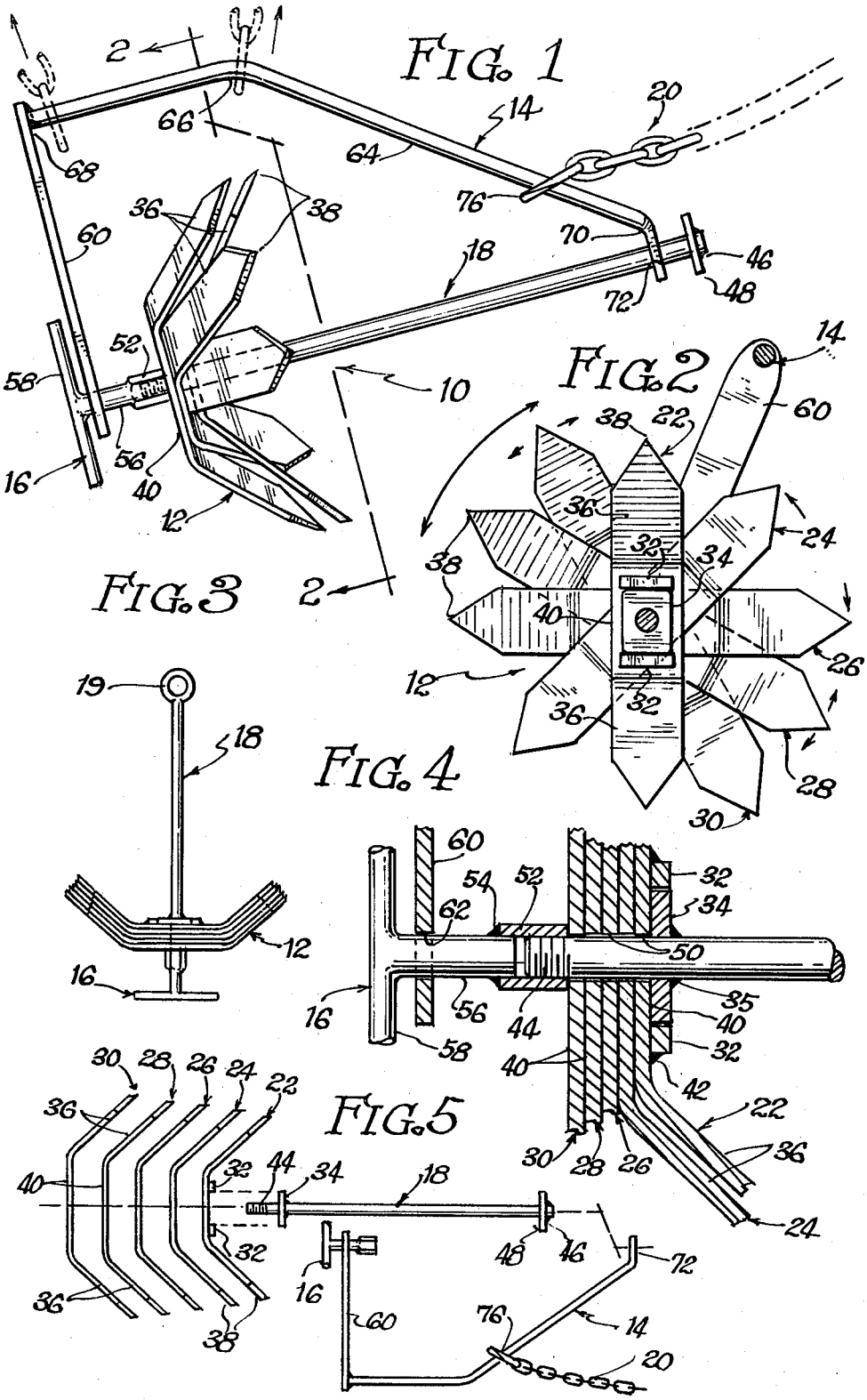
FIG. 1 is a side elevation view of the device.
FIG. 2 is an end view thereof taken along line 2—2 of FIG. 1.
FIG. 3 is a side elevation view of a modification thereof showing the flukes stacked as when not in use.
FIG. 4 is a cut-away detail showing the arrangement for locking the flukes in position for use.
FIG. 5 is an exploded view of the device.

Referring to the drawing wherein like numerals represent like parts throughout, the item numeral 10 generally depicts the crown end of the anchor with 18 being an elongated body serving as the anchor stem or shank.

It is rod shaped and serves as an axis for flukes mounted thereon. There is a rectangular retainer plate or bar 34 with reinforcement 35 integrated transversally on the shaft. It is both a stop for the abutting flukes and its edge offers resistance to two parallel bar shaped bosses 32 welded at 42 onto a fluke. There are threads 44 at the crown end of the shaft for engagement as part of a securing means. Such securing means is for retaining the flukes in position. It preferably includes a retainer 16 comprising shaft 56 having T-shaped handle 58 at one end and threads 52 within enlargement 54 at the other end. In use, the flukes are radially spread to the desired position around the shaft. The operator then rotates handle 16 with one hand and resists shaft rotation by holding fluke 22 firmly in the other hand. The described bosses and plate prevent the shaft from turning. This squeezes and holds the flukes tightly between retainer 16 and plate 34. At the opposite end 46 of the shaft is a shoulder weldment 48. It blocks the bail 14 to keep it from sliding off the shaft.

A modification of my invention may delete the bail. In such alternate form ring 19 is integral with the end of the shaft. It serves as an alternate attachment means to the boat line. See FIG. 3. However, for best results I recommend the bail attaching means.

The bail is composed of relatively long diagonal section 64 extending from bend 70 at one shaft end to lesser bend 66. This forms another section. It is parallel to the shaft. Next, a vertical portion 60 is formed by a right angle bend 68 of the diagonal section. It extends to the shaft. There are orifices 62 and 72 at both ends of the bail for rotatable retention of the shaft. As can be seen in FIG. 1, a slip link 76 on chain 20 moves along the bail. Thus the chain pulls against the bail in the area of bend 70 when setting the anchor. The resulting force, being substantially parallel to the lake or river bed, causes the ends of the flukes to dig into the ground. Later, for retrieval, a tug on the line moves the boat more directly over the anchor. When in this position the operator again pulls on the line. The resolution of forces then results in a much more vertical pull on the bail whereby the chain slips along the diagonal section of the bail to the uppermost parallel portion. A continued pull tends to cause a fluke or flukes to back out of the placement. For more resistant settings or snagging, a greater pulling force may straighten out a bend in a fluke. The anchor will be saved and the fluke need only again be bent for repeated use.

As a final important novel feature I have provided an assembly of unique flukes of uniform configuration. I find that five individual flukes make a desired assembly. Some may be longer than others and sets may be interchangeable. They might be spread fully as in FIG. 2. In such case, a side pull on the bail will cause them to rotate on tips 38. Thus the anchor may be moved out of an area that might otherwise cause fouling. Alternate positioning might be to spread a single fluke out of the pack with all others remaining stacked in tandem. In this instance there would be a two point contact on the bottom with the weight of the stack tending to help imbed the single fluke. Of course various other positioning may be used. The softer the ground material, the greater the spread, as a rule. In the drawings number 40 in the flat central portion of the flukes. The number 36 represents the bent sections. The uniform central orifices being a passageway for slidably mounting on the shaft is number 50. The flukes may be completely aligned as illustrated in item 12 of FIG. 3. This permits convenient transporting to place of use. As shown in FIG. 5, fluke 24 is of slightly larger dimensions than the next preceding fluke 22; fluke 26 is similarly larger than fluke 24; fluke 28 is correspondingly larger than fluke 26 and fluke 30 is proportional to, and larger than the others. The relative dimensions are such that the surface of any fluke is in contact with the entire contacting surface area on adjoining flukes when in the fully aligned position.

I claim:

1. An anchor having adjustable flukes comprising an elongated, rod shaped anchor shaft having a threaded portion on the crown end of the shaft, a rectangular plate secured to said shaft at a distance from said threaded portion to receive and retain a plurality of nestable flukes on the crown end portion of said shaft, said flukes being flat metal bars having an orifice in the planar mid-section of each fluke to receive the crown end of said shaft and bent end portions, the innermost fluke having a pair of spaced parallel bar shaped bosses secured to the surface of the mid-section to receive said retainer plate, said bosses abutting the edges of said retainer plate when said flukes are mounted on said shaft to prevent rotation of said innermost fluke and means to secure said flukes to said shaft in various angular relationships from 0° to 90° relative to each other, said securing means comprising a T-shaped handle having an interiorly threaded enlargement at the end of the handle to engage said threaded portion of said shaft and by rotation of said handle to press said enlargement into contact with the outermost fluke to lock said flukes in one of said selected angular relationships between said retainer plate and said enlargement, and means on said shaft for the attachment of an anchor line comprising a bail having one end slidably-mounted on said T-shaped handle and the other end slidably mounted on the end portion of said anchor shaft opposite said crown end, means on said end portion to prevent said other end of said bail from sliding off said shaft and slidable means on said bail for connection with said anchor line.

* * * * *